US006588220B1

(12) United States Patent
Manini et al.

(10) Patent No.: US 6,588,220 B1
(45) Date of Patent: Jul. 8, 2003

(54) PROCESS FOR THE PRODUCTION OF A REFRIGERATING CIRCUIT COMPRISING NON-EVAPORABLE GETTER MATERIAL

(75) Inventors: Paolo Manini, Arluno Mi (IT); Claudio Boffito, Rho Mi (IT); Alessandro Gallitognotta, Rho Mi (IT); Alessio Corazza, Como (IT)

(73) Assignee: SAES Getters S.p.A., Lainate Mi (IT)

( * ) Notice: Subject to any disclaimer, the term of this patent is extended or adjusted under 35 U.S.C. 154(b) by 0 days.

(21) Appl. No.: 09/716,860

(22) Filed: Nov. 20, 2000

Related U.S. Application Data

(63) Continuation of application No. PCT/IT99/00137, filed on May 17, 1999.

(30) Foreign Application Priority Data

May 21, 1998 (IT) ..... MI98A1137

(51) Int. Cl.[7] ..... F25B 45/00
(52) U.S. Cl. ..... 62/77
(58) Field of Search ..... 62/85, 474, 77

(56) References Cited

U.S. PATENT DOCUMENTS 4,288,993 A 9/1981 van Mensvoort et al.
5,062,273 A * 11/1991 Lee et al. ..... 62/85
5,316,171 A * 5/1994 Danner et al. ..... 220/592.21
5,489,327 A * 2/1996 Otsuka et al. ..... 95/116
5,625,742 A * 4/1997 Boffito et al. ..... 392/345
5,718,119 A 2/1998 Wakita et al.
5,737,941 A * 4/1998 Hsiung et al. ..... 62/636
5,811,816 A * 9/1998 Gallagher et al. ..... 250/352

FOREIGN PATENT DOCUMENTS

EP 0 492 181 A2 7/1992
EP 0 633 420 A2 1/1995

* cited by examiner

*Primary Examiner*—William E. Tapolcai
*Assistant Examiner*—Mohammad M. Ali
(74) *Attorney, Agent, or Firm*—Akin Gump Strauss Hauer & Feld L.L.P.

(57) ABSTRACT

A process is provided for production of a refrigerating circuit comprising non-evaporable getter material, wherein said getter material, previously introduced into the same circuit, is heated to a temperature of at least 200° C. during or immediately after the circuit evacuating step, at a residual atmospheric gas pressure of not less than 10 mbar, before introduction of the mixture of cooling fluids and before the circuit sealing. Preferred is the use of zirconium-based getter alloys.

8 Claims, 1 Drawing Sheet

PROCESS FOR THE PRODUCTION OF A REFRIGERATING CIRCUIT COMPRISING NON-EVAPORABLE GETTER MATERIAL

CROSS REFERENCE TO RELATED APPLICATION

This application is a continuation of International Application PCT/IT99/00137, filed May 17, 1999, the disclosure of which is incorporated herein by reference.

BACKGROUND OF THE INVENTION

The present invention relates to a process for the production of a refrigerating circuit comprising non-evaporable getter material for removing gases, particularly atmospheric gases, from the fluid mixture contained in refrigerating circuits for refrigerators and cooling devices in general.

It is well known that the most common cooling system is based on the physical principle of drop of temperature of a fluid during its evaporation and is employed in domestic or industrial refrigerators, freezers, automatic dispensers of perishable foodstuffs, refrigerated shop-windows, air conditioners, etc. This principle is applied by using closed circuits containing a fluid suitable to be subjected to compression and expansion cycles. The circuit, comprising a compressor, extends mainly with a very small, substantially capillary cross-section, being coil shaped in order to increase the surface available for the exchange of heat, and is normally made of copper, an excellent heat conductor. A molecular sieve filter is generally provided upstream of the coil and the tubular portion of the evaporator with a larger cross-section lies downstream thereof, before the return to the compressor. Usually this is the general configuration, apart from possible variations.

The fluid is selected among those undergoing liquid-vapor phase transition caused by pressure changes in the temperature range of 0–50° C. During the expansion step, a partial evaporation of the liquid occurs, causing its temperature to drop, and heat is removed from the parts to be cooled through the closed circuit metal walls; during the compression step, the previously formed vapor condenses, thus releasing heat that is transferred outside of the system. As cooling fluids chlorofluorocarbons (CFCs) were previously used, but their industrial use has been forbidden because of their reaction with ozone in the upper part of the atmosphere. Hydrogenated CFCs (HCFCs) are used as substitutes, and the use of lower saturated hydrocarbons, such as isobutane ($(CH_3)_3CH$), is spreading. These compounds are generally used in admixture with oils, ensuring the continuous presence of a liquid phase for the correct working and lubrication of the mechanical parts of the compressor. In the following the cooling oil-fluid mixture will be simply referred to as freezing mixture.

The presence, in the pipes composing the closed refrigerating circuit, of gases other than the working fluid vapors, generally atmospheric gases, causes some problems. First, these gases are not condensable by compression at the typical compressor working temperatures (around room temperature), and as a result remain in the circuit as gases. Because of their compressibility, part of the compression/expansion work done by the compressor is transformed into a simple elastic variation of their volume and does not contribute to the evaporation/condensation cycle accomplishing the heat transfer, with the net result of a decrease of the compressor energetic yield. Moreover, the presence of gases in the refrigerating circuit causes noises, annoying especially in the case of domestic refrigerators. Finally, when the cooling fluid is a hydrocarbon, the presence of air involves a certain risk of explosions that, however remote, still is not negligible.

The production of refrigerating closed circuits comprises a step of evacuation of the metallic pipes by mechanical pumping, in order to remove most of the initially contained air, and the successive filling of the circuit with the oil/cooling fluid mixture. However, the normal evacuation operations carried out industrially do not allow a complete gas removal, such as to eliminate the above-described difficulties. A complete evacuation would require long pumping times, unacceptable for industrial applications.

Italian patent application MI 98A 000558 in the name of the same applicant aims at providing a getter system comprising a getter material held within an evacuated chamber having at least one wall contacting the freezing mixture inside the circuit. The wall is made of a material permeable to the gases but not to the fluids constituting the mixture itself.

In this way the non-evaporable getter material sorbs the atmospheric gases, which are present in the cooling fluids during the circuit working life, as soon as the fluid contacts the getter material, in spite of the reduced conductance values of the circuit itself. This results in long times being necessary for sorbing the gases left in the circuit as residues from the production process. The getter material is therefore used as in the high vacuum systems, but these circuits are never under a very high vacuum, and the degassing problem is negligible compared to the advantage of having, already at the start of the operation, the greatest reduction of unwanted gases present in the circuit.

U.S. Pat. No. 5,718,119 discloses methods for eliminating air from a refrigerating circuit during the manufacturing steps thereof. A first method consists in connecting to the refrigerating circuit an air absorbing device containing zeolites, allowing the device time for absorbing air, and then disconnecting the air absorbing device from the circuit prior to its backfilling with the refrigerating fluid. A second method consists in replacing air in the circuit with carbon dioxide ($CO_2$), connecting to the circuit a $CO_2$ sorbing device containing zeolites, calcium hydroxide and calcium chloride, or an epoxy compound, so as to absorb $CO_2$ from the circuit, and then disconnecting the $CO_2$ absorbing device from the circuit prior to its backfilling with the refrigerating fluid. The methods disclosed in this patent are rather complex, in that absorption of atmospheric gases by zeolites requires the use of a supplemental refrigerating unit to cool these down to very low temperatures; the use of the second method requires an additional step of filling with $CO_2$ followed by its removal.

European published patent application EP-A-0 633 420 discloses jackets whose thermal properties may switch from thermally insulating to thermally conducting; the change of condition of the jacket is based on a mechanism of absorption/desorption of hydrogen from materials, generally zirconium-based alloys, showing hydrogen sorption properties that are reversible depending on operation temperature.

BRIEF SUMMARY OF THE INVENTION

The above-mentioned evacuation is obtained according to the present invention without these inconveniences of the prior art by a process for the production of a refrigerating circuit comprising introducing non-evaporable getter material into a refrigerating circuit, evacuating the circuit by pumping, and heating the getter material at a temperature of at least 200° C. during the evacuation or in an immediately subsequent step.

An object of the invention is also a refrigerating circuit made by this process, as well as any apparatus containing such a circuit.

BRIEF DESCRIPTION OF THE DRAWING

These and other objects, advantages and features of the process according to the present invention will be clearer from the following detailed description of the invention with reference to the accompanying drawing. The sole

DETAILED DESCRIPTION OF THE INVENTION

Figure 1:
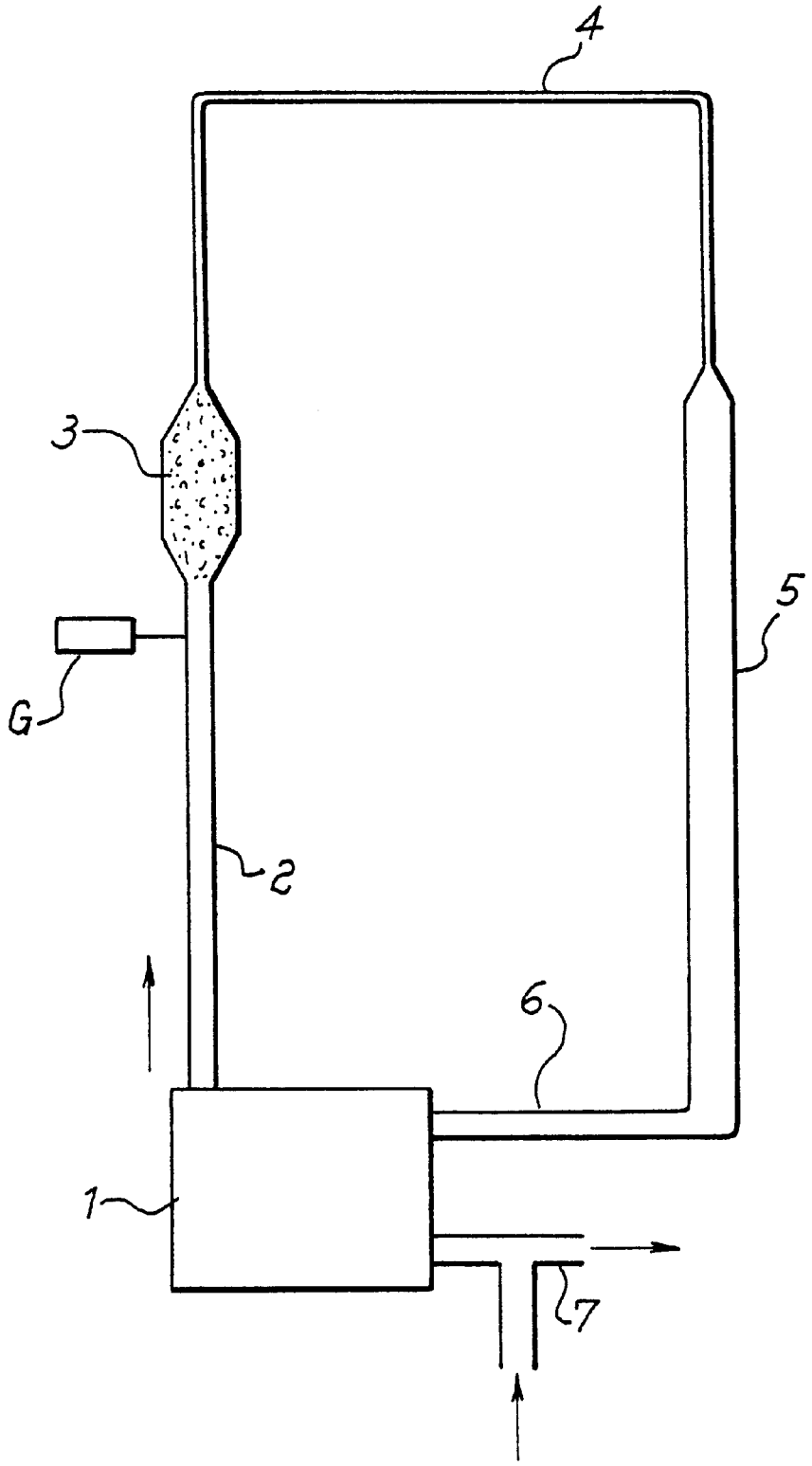
FIG. 1 is a schematic view of a refrigerating circuit suitable to be produced according to the process of the present invention.

According to the invention, before inserting the fluid mixture into the circuit and therefore in the presence of air, a non-evaporable getter, once heated to a temperature of at least 200° C., undergoes a self-feeding exothermic reaction causing in a very short time the almost complete sorption of the present air. The result is an almost complete combustion of the getter material, which is virtually "burned", and then remains inactive for all the refrigerating circuit life, having fulfilled its task, thus being certain that already from the very beginning of the circuit operation, the non-condensable gases therein have been significantly reduced.

With reference to the drawing, a refrigerating circuit is shown suitable to be used, in the generally shown structure, in any cooling apparatus among those above mentioned. It comprises a compressor 1 whose output is connected, through a tubular portion 2 acting as a condenser and a filter 3 made of zeolites or molecular sieves, to a portion 4 extending mainly lengthwise, having a reduced, almost capillary, cross-section with a diameter of about 0.5 mm, and preferably forming volutes as a pipe coil. Portion 4 is followed by a circuit portion 5 having a much larger cross-section, acting as an evaporator. The circuit closes at the compressor through a runback 6 or heat exchanger, normally finned, to achieve a better heat exchange with the environment to be cooled.

A conventional process for the preparation of such a circuit is known, by which, before its closure, the circuit is evacuated by connecting to an external rotary pump an auxiliary pipe 7 provided at the outlet of compressor 1, by which it is connected to the runback 6, so that it sucks out most of the air remaining in the circuit, before introduction of the cooling fluid mixture and before final sealing.

However, because the circuit conductances are relatively low upstream of evaporator 5, in the portion with capillary cross-section 4 and in the condenser 2, which is also resistant to the evacuation because of filter 3, an amount of atmospheric gases which is not negligible is still trapped and can involve the difficulties mentioned at the outset.

According to the present invention, a getter device G with non-evaporable getter material is initially (i.e., prior to introduction of the cooling fluid) introduced into the circuit, in series, in parallel or as a branch thereof. At the end of the evaporation step or even before its completion, but in any event before the cooling fluid introduction, the getter material is heated at a temperature of at least 200° C., enough to start the exothermic reaction occurring in the presence of air, thus exerting thereon the violent sorption due to the getter. Then, the cooling fluid (e.g., isobutane or other) is inserted, and the auxiliary pipe 7 is closed, for example by an operation called "pinch-off."

The refrigerating circuit can therefore start working with a negligible amount of air inside, because all of the atmospheric gases normally present in the portion of the circuit less affected by the removing action exerted by the evacuation pump owing to the reduced system conductance, have been removed by the getter action.

The atmospheric gas partial pressure required to start the exothermic reaction is at least 10 mbar, and preferably the heating to trigger such a reaction takes place when pressure is not higher than 500 mbar. At pressures lower than 10 mbar the reaction heat is not enough for the self-feeding of the gas-sorption reaction, while at pressures higher than 500 mbar the getter is consumed before it can carry out its function of reducing the residual pressure in the circuit. The possibility of working in such a wide pressure range makes the process of the invention versatile, so that it may be carried out at relatively high pressures either during the circuit evacuation step or immediately thereafter, or it may be carried out at the lower values in the above indicated pressure range after the circuit sealing by pinch-off, when the gas has spread back into the circuit itself thus leveling the pressure,.

A non-evaporable getter device heated at such values of residual pressure, however reduced, that do not correspond to the operating conditions of a high vacuum getter (pressure less than 1 mbar), causes an exothermic reaction of sorption of the present air, progressively increasing its temperature until it bums, thus ending its gettering action. The resulting temperature can be so high that in certain cases it is advisable to use special materials for the circuit portions near the getter device, because copper, which is normally used, could be damaged by these temperatures.

The following examples are provided for purely explanatory purposes to teach those skilled in the art the best manner to practice the present invention, without limiting in any way the scope of the invention itself.

EXAMPLE 1

This example refers to a test carried out at the following conditions. As a non-evaporable getter, in the form of fragments, a sintered product of zirconium powder is used with powder of an alloy having a weight percent composition Zr 70%-V 24.6%-Fe 5.4%, produced and sold by applicant under the name St 707. The above-mentioned sintered product, as used in this example, is produced and sold by applicant under the name St 172. More than 10 fragments of such a sintered product, for a total weight of 0.6 g of getter material, are introduced into a test chamber formed as a steel bulb having an internal volume of 52 $cm^3$, connected to a vacuum line and to a manometer.

This volume is smaller than the typical internal volume of the coil of a refrigerating circuit, which is about 90 $cm^3$, but this is not considered to have any influence on the test validity as a simulation of the real process, because at most a greater amount of getter material would be required. Before starting the test, the bulb was evacuated to a residual pressure of 500 mbar measured at room temperature. Then, the metallic bulb was heated from outside to a temperature of about 350° C., and the heating was maintained for 5 minutes. The bulb was then cooled to room temperature, and the residual pressure was measured, which was 145 mbar, thus indicating a percentage of removed air of about 71.3%. This test result, as for all the other examples, is reported in the table below.

EXAMPLE 2

Another test is carried out with the same material and in the same way as Example 1, but the number of fragments of the St 172 material is more than 20 for a total weight of 0.5 g.

EXAMPLE 3

The tests of the previous Examples are repeated, but using as getter material four fragments of the alloy St 707 for a total weight of 0.6 g.

EXAMPLES 4–7

The tests of Example 3 are again repeated with the same material St 707, but changing each time (except for Examples 6 and 7 which were carried out at identical conditions) the number of fragments of the material.

EXAMPLE 8

The test of Example 1 is repeated, but using a test chamber with a volume of 64 $cm^2$ and using as a getter material an alloy, produced and sold by applicant, under the name St 787, with a weight percent composition Zr 80.8%-Co 14.2%-mischmetal 5.0%. The mischmetal used has a weight percent composition of about 50% cerium, 30% lanthanum, 15% neodymium, and the remaining 5% other rare earth metals.

EXAMPLE 9

This test is an example of the functioning of the inventive process at low starting pressures. The test of Example 1 is repeated, operating however in a chamber of volume 1.1 L, and using a tablet of 0.6 g of St 707 as a getter material. The initial pressure in the bulb was 13 mbar.

The results of the tests of all of the above Examples are reported in the following table:

| Test number and mat. | Number of fragments | Getter mat. weight (g) | Starting P (mbar) | Final P (mbar) | Removed air (%) |
|---|---|---|---|---|---|
| 1) St 172 | >10 | 0.6 | 500 | 145 | 71.3 |
| 2) St 172 | >20 | 0.5 | 500 | 5 | 99.0 |
| 3) St 707 | 4 | 0.6 | 500 | 95 | 81.0 |
| 4) St 707 | 6 | 0.7 | 500 | 9 | 98.2 |
| 5) St 707 | 1 | 0.6 | 500 | 26 | 94.8 |
| 6) St 707 | 2 | 1.2 | 500 | 6 | 98.9 |
| 7) St 707 | 2 | 1.2 | 500 | 8 | 98.5 |
| 8) St 787 | 4 | 0.6 | 500 | 100 | 80 |
| 9) St 707 | 1 | 0.6 | 13 | 1 | 92.3 |

The results indicated in the above table show, as expected from the invention, that the greater the amount of getter material (compare tests 6 and 7 with tests 3–5) and the thinner the particles (compare test 2 with test 1 and test 4 with tests 3 and 5), the more effective is the removal. In all cases it is evident that the sorption level is extremely good, in some cases approaching 100% (examples 2, 4, 6, and 7).

As stated above, it is an object of the present invention to also produce a refrigerating circuit by the above described process, as well as any cooling, air-conditioning, etc. device containing such a circuit.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A process for production of a refrigerating circuit, comprising introducing non-evaporable getter material into the refrigerating circuit, evacuating the circuit by pumping, and heating the getter material at a temperature of at least 200° C. during the evacuation or in an immediately subsequent step, wherein residual pressure of atmospheric gases present is in a range of about 10 to 500 mbar.

2. The process according to claim 1, wherein said non-evaporable getter material is positioned in series, in parallel or as a branch, in a zone of reduced conductance, upstream of a bottlenecked portion of the refrigerating circuit.

3. The process according to claim 1, wherein, after introducing the non-evaporable getter into the circuit, a cooling fluid mixture is introduced before final sealing.

4. The process according to claim 1, wherein said non-evaporable getter material comprises a zirconium-based alloy.

5. The process according to claim 4, wherein the non-evaporable getter material is a ternary Zr—V—Fe alloy.

6. The process according to claim 5, wherein said ternary alloy has a weight percent composition of Zr 70%-V 24.6%-Fe 5.4%.

7. The process according to claim 4, wherein said getter material is formed of a sintered product of zirconium powder with powder of a ternary Zr—V—Fe alloy.

8. The process according to claim 4, wherein the non-evaporable getter material is a Zr—Co-mischmetal alloy.

* * * * *